US010132538B2

(12) United States Patent
Fritz

(10) Patent No.: US 10,132,538 B2
(45) Date of Patent: Nov. 20, 2018

(54) HEAT EXCHANGER WITH INTEGRATED SUBCOOLER

(75) Inventor: Steve L. Fritz, St. Charles, MO (US)

(73) Assignee: Hussmann Corporation, Bridgeton, MO (US)

( * ) Notice: Subject to any disclaimer, the term of this patent is extended or adjusted under 35 U.S.C. 154(b) by 513 days.

(21) Appl. No.: 13/480,688

(22) Filed: May 25, 2012

(65) Prior Publication Data

US 2013/0312441 A1 Nov. 28, 2013

(51) Int. Cl.

| | |
|---|---|
| ***F25B 39/02*** | (2006.01) |
| ***F28F 9/02*** | (2006.01) |
| ***F25B 40/00*** | (2006.01) |
| ***F28D 1/02*** | (2006.01) |

(52) U.S. Cl.

CPC ..... *F25B 39/022* (2013.01); *F25B 40/00* (2013.01); *F28F 9/0234* (2013.01); *F25B 2500/18* (2013.01); *F28D 2001/0273* (2013.01)

(58) Field of Classification Search

CPC ..... F25B 40/02; F25B 2400/0417
USPC ..... 165/173–175, 138, 154, 66, 104.11, 165/104.19; 62/525, 113
See application file for complete search history.

(56) References Cited

U.S. PATENT DOCUMENTS 5,014,770 A * 5/1991 Palmer ..... F24D 3/005 165/48.2
5,212,965 A * 5/1993 Datta ..... 62/515
5,243,837 A * 9/1993 Radermacher ..... F25B 5/04 62/113
6,189,334 B1 * 2/2001 Dienhart ..... B60H 1/3229 165/140
6,442,967 B1 * 9/2002 Alsenz ..... 62/513
6,745,827 B2 6/2004 Lee et al.
7,114,349 B2 10/2006 Lifson et al.
7,621,150 B2 * 11/2009 Kadle et al. ..... 62/513
7,640,970 B2 1/2010 Kim et al.
7,806,171 B2 * 10/2010 Taras et al. ..... 165/174
7,921,904 B2 4/2011 Matter et al.
7,967,060 B2 6/2011 Trumbower et al.
2007/0039724 A1 * 2/2007 Trumbower ..... F25B 39/028 165/174
2008/0173434 A1 7/2008 Matter et al.
2009/0211743 A1 8/2009 Schrader et al.
2010/0252242 A1 10/2010 Xiangxun et al.
2010/0282454 A1 11/2010 Jiang et al.
2011/0030420 A1 2/2011 Kirkwood
2011/0061845 A1 3/2011 Wand
2011/0094257 A1 4/2011 Rusinguolo et al.
(Continued)

FOREIGN PATENT DOCUMENTS

WO 2008060270 5/2008

*Primary Examiner* — Orlando E Aviles Bosques
*Assistant Examiner* — Steve Tanenbaum
(74) *Attorney, Agent, or Firm* — Michael Best & Friedrich LLP

(57) ABSTRACT

A heat exchanger assembly includes a plurality of tubes, each having an inlet end and an outlet end. An inlet header is configured to receive a cooling fluid and to distribute the cooling fluid to the inlet ends of the plurality of tubes. An outlet header includes an outer shell and defines an outlet chamber. The outlet chamber is configured to receive cooling fluid discharged from the outlet ends of the plurality of tube. A supply conduit supplies the cooling fluid to the inlet header. The supply conduit includes a conduit portion extending through the outlet header.

20 Claims, 7 Drawing Sheets

(56) References Cited

U.S. PATENT DOCUMENTS

| | | | | |
|---|---|---|---|---|
| 2011/0127015 | A1 | 6/2011 | Taras et al. | |
| 2011/0174469 | A1* | 7/2011 | Kim | F28D 7/106 165/154 |
| 2011/0239697 | A1* | 10/2011 | Styles | F25B 39/022 62/524 |

* cited by examiner

HEAT EXCHANGER WITH INTEGRATED SUBCOOLER

BACKGROUND

The present invention relates to cooling systems, and more specifically, to vapor-compression cooling systems.

Vapor compression cooling systems generally include a compressor, a condenser, an expansion device, and an evaporator, with a cooling fluid, such as a refrigerant, circulating between these components. The circulating refrigerant enters the compressor as a vapor and is compressed to a higher pressure, superheated vapor. The superheated vapor refrigerant is routed through the condenser. In the condenser, the refrigerant is cooled and condensed into a saturated liquid state. The liquid refrigerant is then routed to the expansion device. In the expansion device, pressure of the refrigerant is rapidly lowered, causing a portion of the refrigerant to evaporate. The refrigerant enters the evaporator as a liquid-vapor mixture, and evaporation continues through the evaporator, resulting in the cooling of fluids, such as circulating air, passing over the evaporator.

In order to increase the efficiency of a vapor-compression cooling system, it is desirable to maximize the quality of the liquid refrigerant entering the expansion device.

SUMMARY

In one embodiment, the invention provides a heat exchanger assembly. The heat exchanger assembly includes a plurality of tubes, each having an inlet end and an outlet end. An inlet header is configured to receive a cooling fluid and to distribute the cooling fluid to the inlet ends of the plurality of tubes. An outlet header includes an outer shell and defines an outlet chamber. The outlet chamber is configured to receive cooling fluid discharged from the outlet ends of the plurality of tube. A supply conduit supplies the cooling fluid to the inlet header. The supply conduit includes a conduit portion extending through the outlet header.

In another embodiment, the invention provides a method of operating a heat exchanger assembly. A plurality of tubes are provided, each having an inlet end and an outlet end. A cooling fluid is supplied to the inlet ends through an inlet header. The cooling fluid is passed through each of the plurality of tubes from the inlet end to the outlet end. The cooling fluid is received from the outlet ends in an outlet header. A conduit portion of a supply conduit is routed through the outlet header. The supply conduit supplies cooling fluid to the inlet header after passing through the conduit portion.

In yet another embodiment, the invention provides a heat exchanger assembly. A plurality of tubes each extend from an inlet end to an outlet end. An inlet header is configured to receive a refrigerant and to distribute the refrigerant to the inlet ends of the plurality of tubes. A liquid to suction heat exchanger includes a suction header receiving vapor refrigerant discharged from the outlet ends of the plurality of tubes, and a liquid conduit fluidly connected to the inlet header upstream of the inlet header. The liquid conduit is thermally coupled to the suction header for heat transfer between liquid refrigerant in the liquid conduit and the vapor refrigerant in the suction header.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
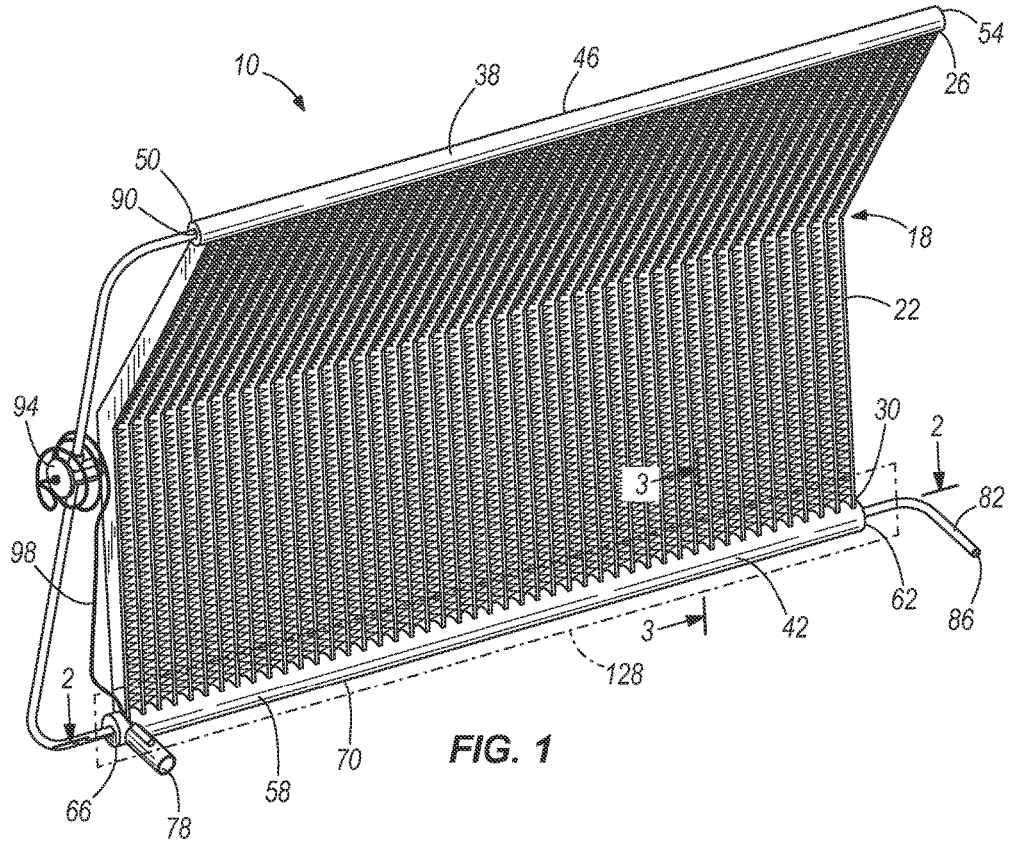
FIG. 1 is a perspective view of a cooling assembly.
Figure 7:
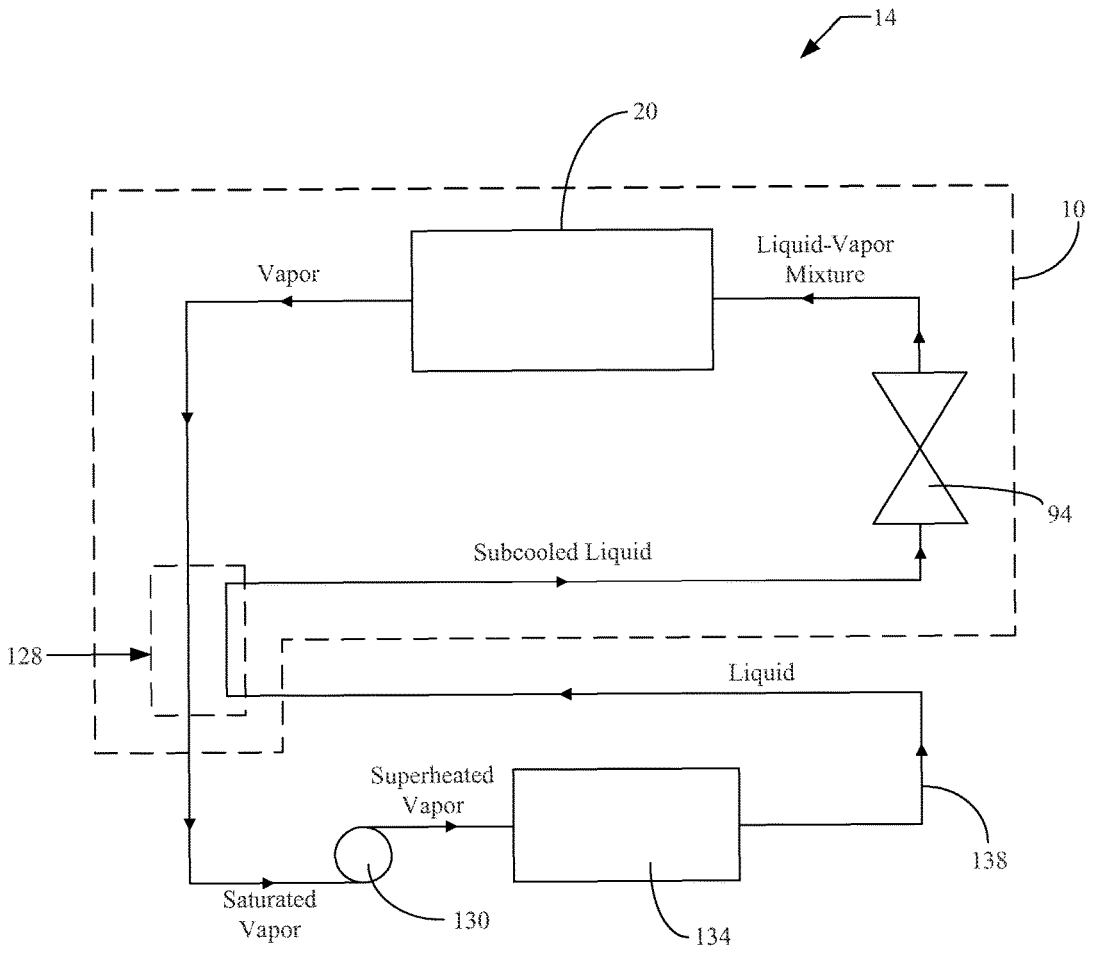
FIG. 7 is a block diagram of a vapor-compression refrigeration system including the heat exchanger assembly of FIG. 1.

FIG. 1 illustrates a cooling heat exchanger assembly 10. The cooling assembly 10 may be used as part of a vapor compression system 14 (as shown in FIG. 7), such as a refrigeration system, air conditioner, or heat pump.

Referring to FIG. 1, the cooling assembly 10 includes a heat exchanger 18. The heat exchanger may function, for instance, as an evaporator. The heat exchanger 18 includes a plurality of tubes, and specifically micro-channel tubes 22. The micro-channel tubes 22 have an inlet end 26 and an outlet end 30. The heat exchanger 18 includes a plurality of fins 34 (FIG. 3) that are coupled to and positioned between the micro-channel tubes 22 along a portion of the length of the tubes 22 in the longitudinal direction of the tubes 22). Generally, the fins 34 aid in heat transfer between air passing through the heat exchanger 18 and refrigerant flowing within the micro-channel tubes 22 by increasing the surface area of thermal contact. As illustrated, the fins 34 are generally arranged in a zigzag pattern between the adjacent micro-channel tubes 22.

The heat exchanger 18 also includes an inlet header 38 and an outlet header 42. Referring to FIG. 1, the micro-channel tubes 22 extend between the inlet header 38 at the inlet end 26 and the outlet header 42 at the outlet end 30.

The inlet header 38 includes a cylindrical tube 46 having a first end 50 and a second end 54. The first end 50 is configured to receive a refrigerant. The inlet header 38 distributes the refrigerant to the inlet end 26 of the heat exchanger 18.

Figure 2:
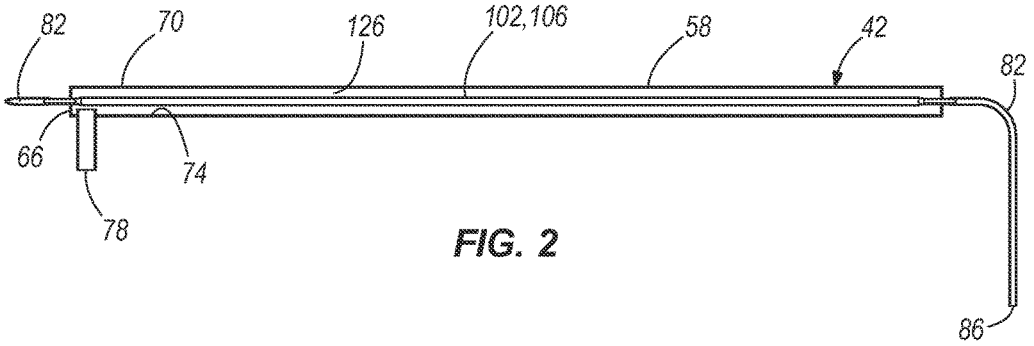
FIG. 2 is a section view taken along section line 2-2 of FIG. 1.
Figure 3:
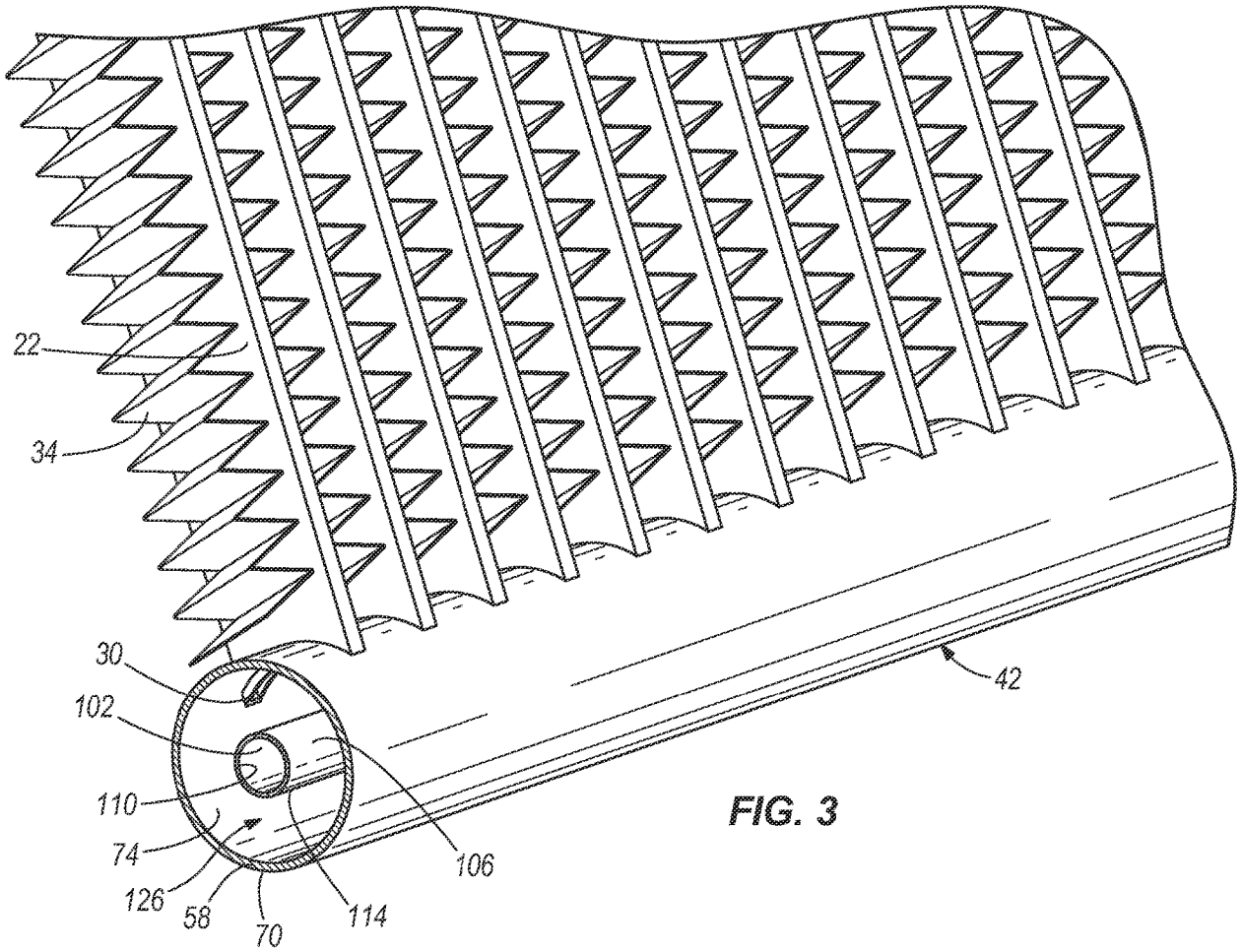
FIG. 3 is a section view taken along section line 3-3 of FIG. 1.

As shown in FIG. 1, the outlet end 30 of the heat exchanger 18 is fluidly coupled to the outlet header 42 to discharge the refrigerant to the outlet header 42. The outlet header 42 includes an outer shell 58. The outer shell 58 extends from a first end 62 to a second end 66. Referring to FIG. 3, the outer shell 58 includes an outer surface 70 and an inner surface 74. As shown in FIG. 2, an outlet port 78 is defined at the second end 66 of the outer shell 58.

Referring to FIGS. 1 and 2, the cooling assembly 10 includes a supply conduit 82. The supply conduit 82 extends from a condenser end 86, through the outer shell 58, to a discharge end 90 coupled to the first end 50 of the inlet header 38, as shown in FIG. 1. The supply conduit 82 supplies refrigerant to the inlet header 38. As shown in FIG. 1, a thermal expansion valve 94 is disposed in the supply conduit 82 upstream of the inlet header 38. The thermal expansion valve 94 receives the refrigerant from the supply conduit 82. A thermal element 98 is coupled to the thermal expansion valve 94 and connects the thermal expansion valve 94 to the outlet port 78.

Referring to FIG. 2, the supply conduit 82 further includes a conduit portion 102 that is contained within the outlet header 42. Referring to FIG. 3, the conduit portion 102 includes a tubular member 106 with an inner surface 110 and an outer surface 114. The tubular member 106 is substantially coaxial with the outer shell 58 of outlet header 42 and extends from the first end 62 of the outer shell 58 to the second end 66 of the outer shell 58.

Referring to FIG. 3, the inner surface 110 and outer surface 114 of the tubular member 106 are substantially smooth.

As illustrated in FIGS. 2-3, an annular space between the outer surface 114 of the tubular member 106 and the inner surface 74 of the outer shell 58 defines an outlet chamber 126. The outlet chamber 126 is in fluid communication with the outlet end 30 of the heat exchanger 18 such that the outlet end 30 of the heat exchanger 18 discharges the refrigerant into the outlet chamber 126 and around the conduit portion 102. The outlet header 42 and conduit portion 102 together define a liquid to suction heat exchanger or subcooler 128.

The cooling assembly 10 of FIGS. 1-3 may be part of a vapor compression system 14, such as illustrated in FIG. 7. The vapor compression system 14 includes the cooling assembly 10, a compressor 130, and a condenser 134, interconnected by a refrigerant loop 138. Circulating refrigerant enters the compressor 130 as a vapor and is compressed to a higher pressure, superheated vapor. The superheated vapor refrigerant is routed through the condenser 134. In the condenser 134, the refrigerant is cooled and condensed into the saturated liquid state. The liquid refrigerant is then routed to the cooling assembly 10.

Referring to 1, the condenser end 86 of the supply conduit 82 receives the liquid refrigerant from the condenser 134. The liquid refrigerant passes through the conduit portion 102 (FIG. 2), where it is subcooled by vapor refrigerant contained within the outlet chamber 126 into a subcooled liquid refrigerant. Referring to FIG. 1, the subcooled liquid refrigerant is then routed to the thermal expansion valve 94 through the supply conduit 82. Within the expansion valve 94, pressure of the refrigerant is rapidly lowered, such that the refrigerant forms a liquid vapor mixture.

The liquid-vapor mixture is further routed in the supply conduit 82 from the thermal expansion valve 94 to the first end 50 of the inlet header 38. Within the inlet header 38, the liquid-vapor mixture is distributed to the inlet end 26 of the micro-channel tubes 22. The liquid-vapor mixture is routed from the first end 50 of the inlet header 38 through the plurality of micro-channel tubes 22 where it evaporates into a vapor.

The vapor refrigerant is discharged from the outlet 30 end of the micro-channel tubes 22 into the outlet chamber 126 of the outlet header 42. The vapor contained within the outlet header 42 is discharged through the outlet port 78 of the outer shell 58 to the compressor 130 (FIG. 7), where it is compressed and cycled back to the condenser 134.

Figure 4:
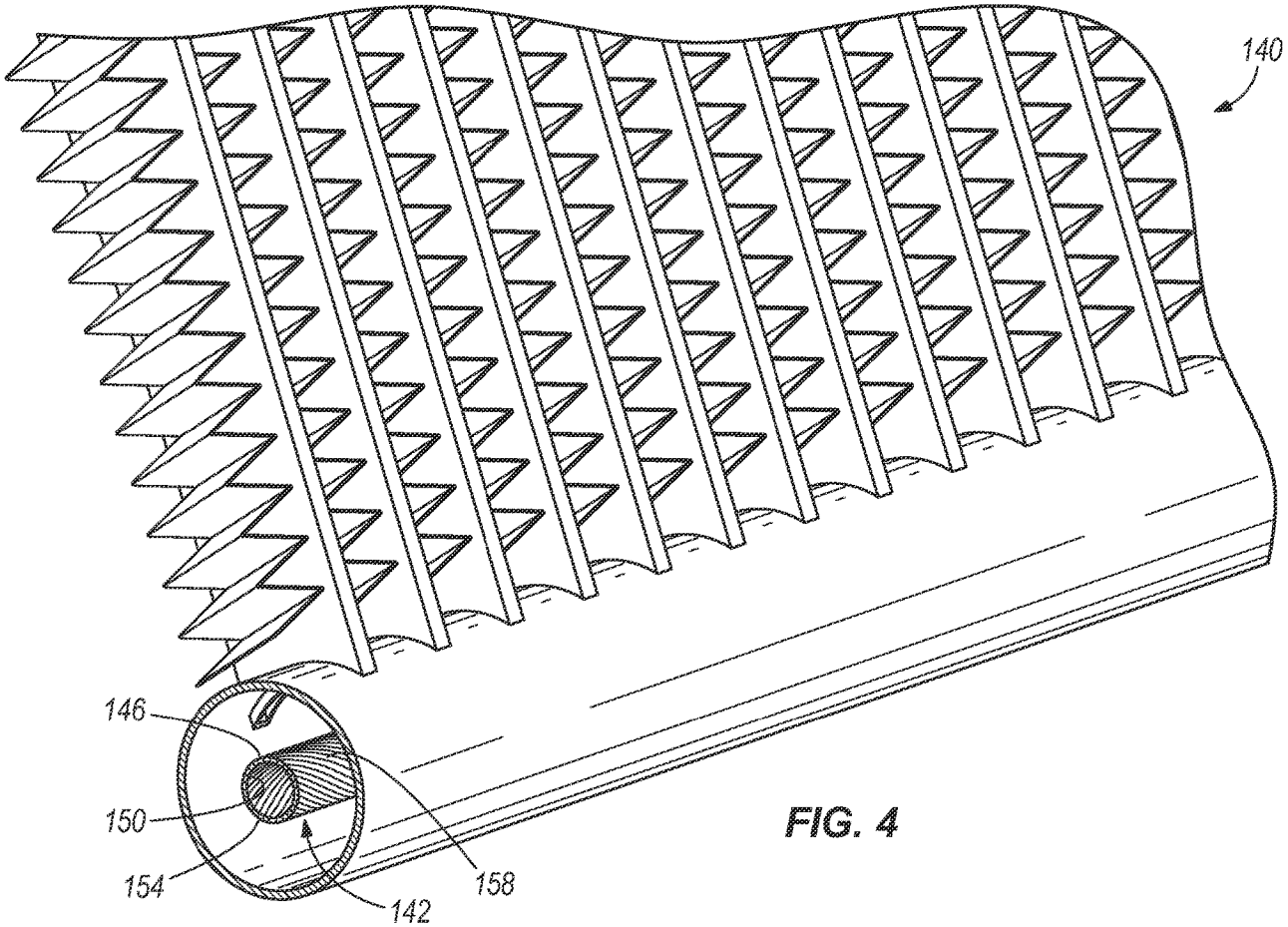
FIG. 4 is a similar section view illustrating another embodiment of the invention.

FIG. 4 shows an alternative embodiment of a cooling assembly 140. In the embodiment of FIG. 4, a cooler portion 142 includes tubular member 146. An inner surface 150 and an outer surface 154 of the tubular member 146 define helical grooves 158 to improve heat transfer.

Figure 5:
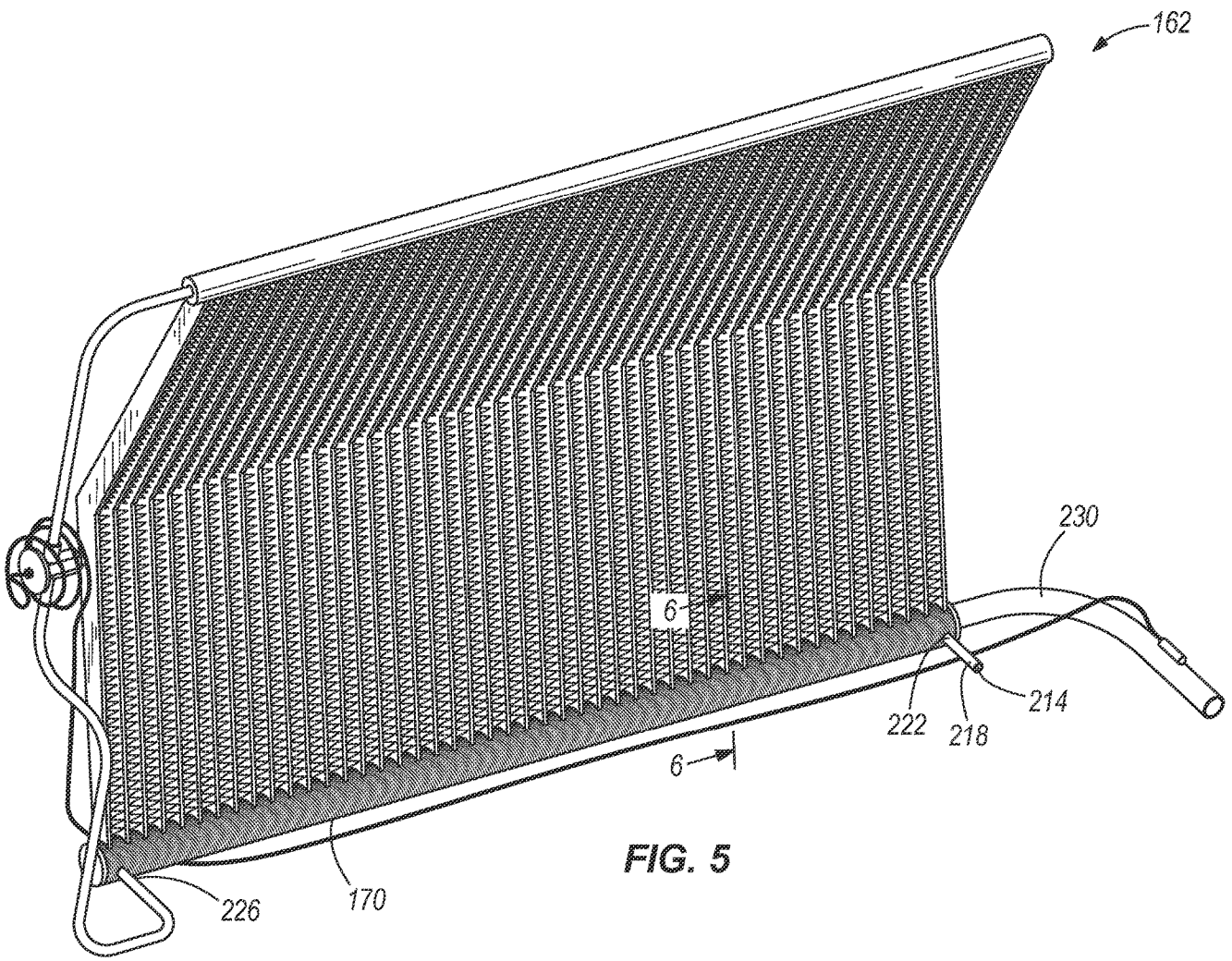
FIG. 5 is a perspective view of a cooling assembly according to another embodiment of the invention.

FIG. 5 shows another alternative embodiment of a cooling assembly 162. The cooling assembly 162 has substantial similarities to the cooling assembly 10 described with respect to FIGS. 1-3 and FIG. 7. Only the components that differ from the embodiments of FIGS. 1-3 will be described herein.

Figure 6:
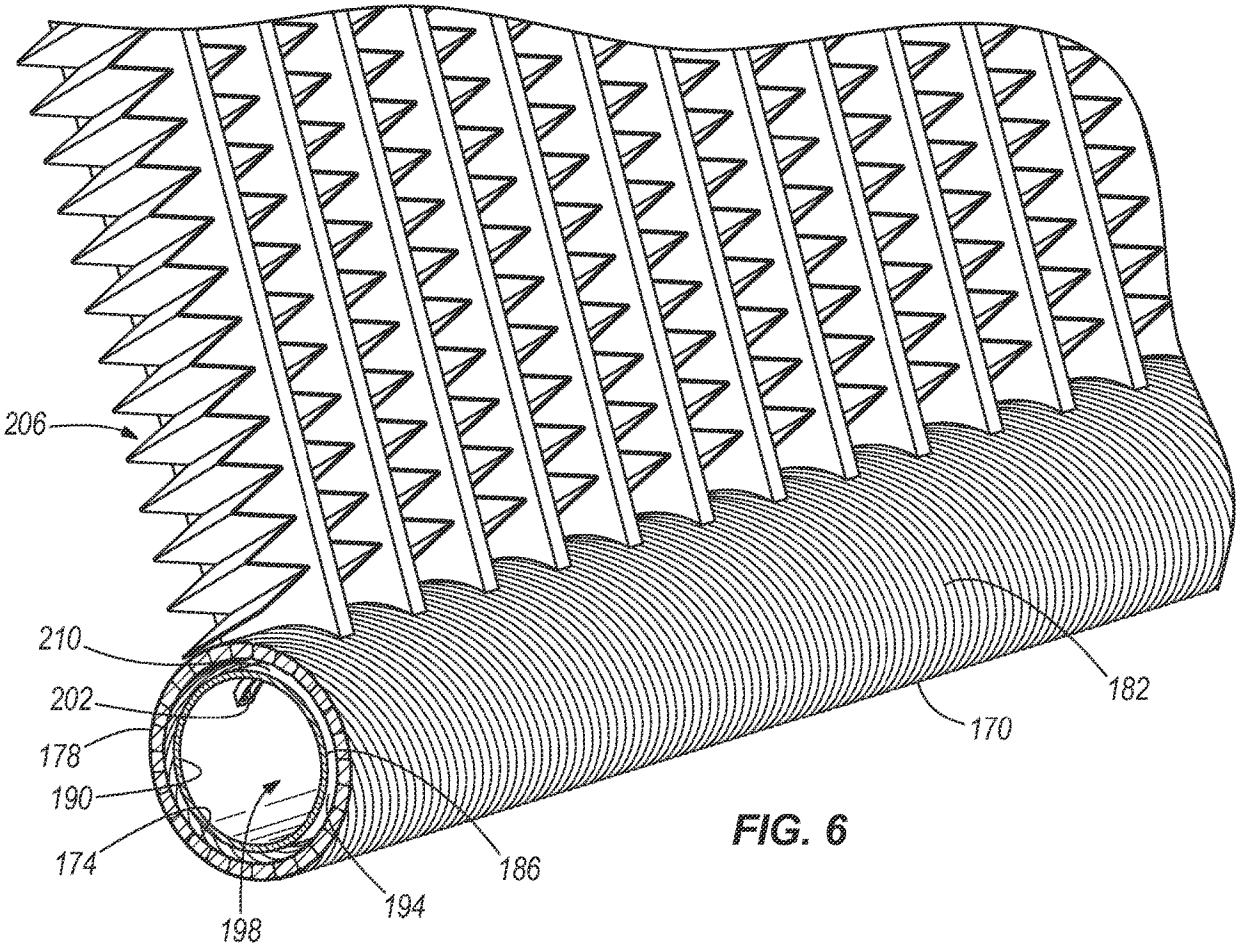
FIG. 6 is a section view taken along section line 6-6 of FIG. 5.

Referring to FIG. 5, an outlet header 166 includes an outer shell 170. Referring to FIG. 6, the outer shell 170 has an inner surface 174 and an outer surface 178. The inner surface 174 and the outer surface 178 define helical grooves 182.

The outer shell 170 surrounds an outlet chamber tube 186. The outlet chamber tube 186 has an outer surface 190 and an inner surface 194. As shown in FIG. 6, an outlet chamber 198 is defined by the inner surface 194 of the outlet chamber tube 186. An outlet end 202 of the heat exchanger 206 is in fluid communication with the outlet chamber tube 186 to discharge vapor into the outlet chamber 198.

An annular space between the inner surface 174 of the outer shell 174 and the outer surface 190 of the outlet chamber 186 defines a cooler portion 210 of a supply conduit 218. Referring to FIG. 5, a condenser end 214 of the supply conduit 218 enters the outer shell 170 at a subcooler inlet 222. The supply conduit 218 exits the outer shell 170 at a subcooler outlet 226.

Liquid refrigerant entering the annular cooler portion 210 is subcooled by vapor contained within the outlet chamber 198. Vapor exits the outlet chamber 198 via a vapor outlet tube 230.

Figure 8:
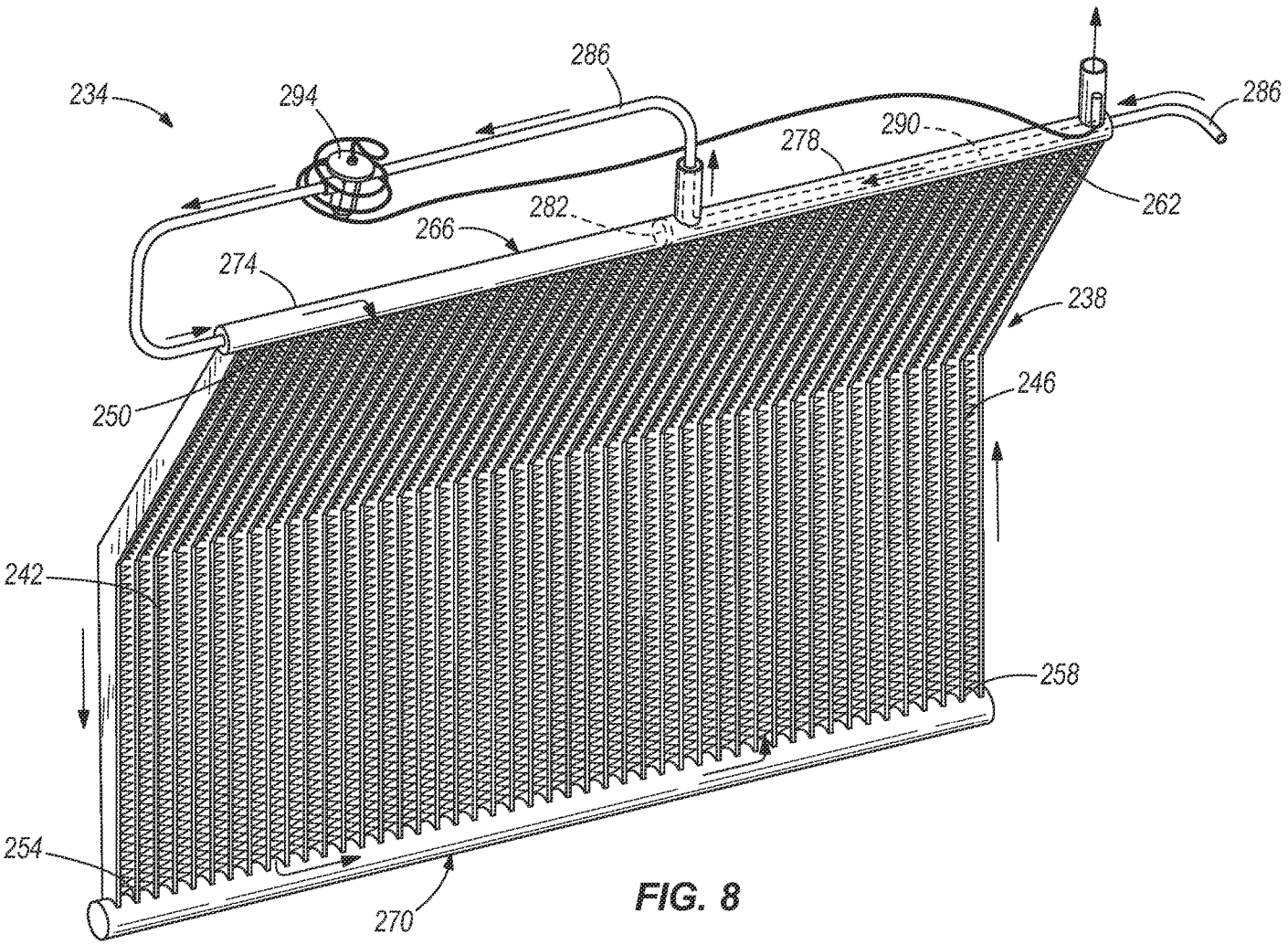
FIG. 8 is a perspective view of a cooling assembly according to another embodiment of the invention.

FIG. 8 shows another alternative embodiment of a cooling assembly 234. The cooling assembly has similarities to the cooling assembly 10 described with respect to FIGS. 1-3 and FIG. 7. Only the components that differ from the embodiments of FIGS. 1-3 will be described herein.

The cooling assembly 234 includes a dual pass heat exchanger 238. The heat exchanger 238 includes first pass tubes 242 and second pass tubes 246. The first pass tubes 242 have an inlet end 250 and an outlet end 254. The second pass tubes 246 have an inlet end 258 and outlet end 262 disposed, respectively, substantially laterally offset from the inlet end 250 and outlet end 254 of the first pass tubes 242.

The heat exchanger 238 also includes a combination header 266 and an intermediate header 270. The combination header 266 includes an inlet header portion 274 (also referred to as an inlet header 274) and an outlet header portion 278 (also referred to as an outlet header 278). The inlet header portion 274 and outlet header portion 278 are separated by a bulkhead or baffle 282. The first pass tubes 242 receive refrigerant from the inlet header portion 274 at the inlet end 250 and discharge refrigerant to the intermediate header 270 at the outlet end 254. The intermediate header 270 then redirects the refrigerant in a lateral direction to the inlet end 258 of the second pass tubes 246. Refrigerant passes through the second pass tubes 246 in a direction substantially opposite the direction of the first pass tubes 242, and is discharged to the outlet header portion 278.

A supply conduit 286 includes a conduit portion 290 extending through the outlet header portion 278. Liquid refrigerant passing through the conduit portion 290 is subcooled by vapor refrigerant contained within the outlet header portion 278, into a subcooled liquid refrigerant. The subcooled liquid refrigerant is then routed through the supply conduit 286 to a thermal expansion valve 294. Within the expansion valve 294, pressure of the refrigerant is rapidly lowered, such that the refrigerant forms a liquid vapor mixture. The liquid-vapor mixture is further routed in the supply conduit 286 from the thermal expansion valve 294 to the inlet header portion 274.

Thus, the invention provides, among other things, a cooling assembly. Various features and advantages of the invention are set forth in the following claims.

What is claimed is:

1. A heat exchanger assembly comprising:

a heat exchanger including a plurality of tubes, each having an inlet end and an outlet end;

an inlet header configured to receive a cooling fluid along a flow direction and to distribute the cooling fluid to the inlet ends of the plurality of tubes; and an outlet header including an outer shell and defining an outlet chamber, the outlet header attached to the outlet ends of the tubes, the outlet chamber configured to receive cooling fluid discharged from the outlet ends of the plurality of tubes such that cooling fluid flows from the tubes directly into the outlet header;

a supply conduit for supplying the cooling fluid to the inlet header, the supply conduit including a conduit portion extending through the outlet header, and the supply conduit routed completely external to the heat exchanger for a distance extending from the outlet header where the supply conduit exits the outlet header to the inlet header in the flow direction; and an expansion valve coupled to the supply conduit between an outlet of the conduit portion and the inlet header in the flow direction.

2. The cooling assembly of claim 1, wherein the outer shell substantially encloses the conduit portion.

3. The cooling assembly of claim 2, wherein the conduit portion is substantially coaxial with the outlet header.

4. The cooling assembly of claim 2, wherein the outlet header further includes an outlet chamber tube at least partially defining the outlet chamber, and wherein the conduit portion is at least partially defined by an annular space between the outer shell and the outlet chamber tube.

5. The cooling assembly of claim 4, wherein a surface of the conduit portion defines helical grooves.

6. The cooling assembly of claim 1, wherein a surface of the outer shell defines helical grooves.

7. The cooling assembly of claim 1, wherein the conduit portion is defined by a tubular member disposed within the outer shell.

8. The cooling assembly of claim 7, wherein a surface of the tubular member defines helical grooves.

9. The cooling assembly of claim 7, wherein a surface of the tubular member defines surface-area increasing features.

10. The cooling assembly of claim 1, wherein the expansion valve receives the cooling fluid from the supply conduit and is disposed upstream of the inlet header.

11. The cooling assembly of claim 10, wherein the expansion valve receives subcooled liquid refrigerant from the supply conduit.

12. A method of operating a heat exchanger assembly, the method comprising:

providing a heat exchanger including an inlet header, an outlet header, and a plurality of tubes, each of the plurality of tubes having an inlet end and an outlet end;

attaching the outlet ends of the tubes to the outlet header;

supplying a cooling fluid along a flow direction to the inlet ends through the inlet header;

passing the cooling fluid through each of the plurality of tubes from the inlet end to the outlet end;

receiving the cooling fluid directly from the outlet ends in an outlet header such that the cooling fluid flows from the tubes directly into the outlet header;

routing a conduit portion of a supply conduit through the outlet header; and routing the supply conduit completely external to the heat exchanger for a distance extending from an outlet of the conduit portion where the supply conduit exits the outlet header to the inlet header in the flow direction, the supply conduit supplying cooling fluid to the inlet header after passing through the conduit portion and an expansion valve coupled between the outlet of the conduit portion and the inlet header in the flow direction.

13. The method of claim 12, wherein the act of routing the conduit portion of the supply conduit through the outlet header includes routing the conduit portion of the supply conduit between an outer shell and an outlet chamber tube of the outlet header.

14. The method of claim 12, further comprising subcooling the cooling fluid in the portion of the supply conduit routed through the outlet header.

15. The method of claim 12, further comprising supplying the cooling fluid to the expansion valve upstream of the inlet header.

16. The method of claim 15, wherein the cooling fluid is supplied to the expansion valve as a subcooled liquid.

17. A heat exchanger assembly comprising:

a heat exchanger including a plurality of tubes, each of the of tubes extending from an inlet end to an outlet end;

an inlet header configured to receive a refrigerant and to distribute the refrigerant to the inlet ends of the of tubes;

an outlet header attached to the outlet ends of the second set of tubes; and a liquid to suction heat exchanger including:

a suction header at least partially defined by the outlet header and receiving vapor refrigerant discharged directly from the outlet ends of the tubes, and a liquid conduit fluidly and physically connected to the inlet header upstream of the inlet header, the liquid conduit thermally coupled to the at least portion of the suction header defined by the outlet header for heat transfer between liquid refrigerant in the liquid conduit and vapor refrigerant in the suction header, wherein the liquid conduit is routed completely external to the plurality of tubes from where the liquid conduit exits the suction header to where the liquid conduit is connected to the inlet header.

18. The cooling assembly of claim 17, wherein the liquid to suction heat exchanger includes an outer shell.

19. The cooling assembly of claim 18, wherein the outer shell at least partially defines the liquid conduit.

20. The cooling assembly of claim 18, wherein the outer shell at least partially defines the suction header.

* * * * *